United States Patent [19]

Robertson

[11] Patent Number: 5,017,549

[45] Date of Patent: May 21, 1991

[54] ELECTROMAGNETIC MEISSNER EFFECT LAUNCHER

[75] Inventor: Glen A. Robertson, Harvest, Ala.

[73] Assignee: The United States of America as represented by the Administrator of the National Aeronautics and Space Administration, Washington, D.C.

[21] Appl. No.: 429,515

[22] Filed: Oct. 31, 1989

[51] Int. Cl.[5] ..... F41B 6/00

[52] U.S. Cl. ..... 505/1; 89/8; 124/3; 244/63

[58] Field of Search ..... 89/8; 124/3; 244/63; 310/13, 14; 318/135

[56] References Cited

U.S. PATENT DOCUMENTS

| | | | |
|---|---|---|---|
| 1,020,943 | 3/1912 | Bachelet | 310/13 |
| 4,432,333 | 2/1984 | Kurherr | 89/8 |
| 4,939,976 | 7/1990 | Minovitch | 89/8 |

FOREIGN PATENT DOCUMENTS

| | | | |
|---|---|---|---|
| 1903959 | 8/1970 | Fed. Rep. of Germany | 89/8 |
| 2829747 | 1/1980 | Fed. Rep. of Germany | 124/3 |
| 1332109 | 6/1963 | France | 124/3 |
| 238399 | 10/1988 | Japan | 124/3 |
| 1023098 | 1/1989 | Japan | 124/3 |
| 196500 | 8/1989 | Japan | 124/3 |
| 2211589 | 7/1989 | United Kingdom | 124/3 |

OTHER PUBLICATIONS

Bean et al., "Superconductors as Permanent Magnets", Journal of Applied Physics, vol. 33, No. 11, Nov. 1962, pp. 3334–3337.

Kolm et al., "Basic Principles of Coaxial Launch Technology", IEEE Transactions on Magnetics, vol. MAG-20, No. 2, Mar. 1984.

Mongeau, Peter, "Analysis of Helical Brush Commutation", IEEE Transactions on Magnetics, vol. MAG-20, No. 2, Mar. 1984.

Rose-Innes et al., Introduction to Superconductivity, 1969, pp. 20–22.

Peaslee, A. T., Proceedings of the Impact Fusion Workshop, LA-8000-C, Aug. 1979, pp. 8–12.

*Primary Examiner*—Stephen C. Bentley

*Attorney, Agent, or Firm*—William J. Sheehan; Jerry L. Seemann; Robert L. Broad, Jr.

[57] ABSTRACT

An electromagnetic projectile launcher provides acceleration of a superconducting projectile through the diamagnetic repulsion of the superconducting projectile. A superconducting layer is provided aft of the projectile, either directly on the projectile or on a platform upon which the projectile is carried, and a travelling magnetic field is caused to propagate along a magnetic field drive coil in which the projectile is disposed. The resulting diamagnetic repulsion between the superconducting projectile and the travelling magnetic field causes the projectile to be propelled along the coil. In one embodiment, a segmented drive coil is used to generate the travelling magnetic field.

9 Claims, 3 Drawing Sheets

ELECTROMAGNETIC MEISSNER EFFECT LAUNCHER

ORIGIN OF THE INVENTION

The invention described herein was made by an employee of the United States Government and may be manufactured and used by or for the Government for Government purposes without payment of royalties thereon or therefor.

FIELD OF THE INVENTION

This invention relates to electromagnetic projectile launchers and, in particular, to an electromagnetic projectile launcher wherein acceleration of a semiconducting projectile is provided through the diamagnetic repulsion between an electromagnetic launch coil and the projectile.

BACKGROUND OF THE INVENTION

Numerous electromagnetic accelerators have been designed for the purpose of providing projectile propulsion. An example of such an accelerator is a electromagnetic coaxial launcher (ECL) disclosed in Kolm et al, "Basic Principles of Coaxial Launch Technology," IEEE Transactions on Magnetics, Vol. Mag-20, No. 2, pp. 227–230 (March 1984). That launcher employs a pair of coaxial coils to generate a traveling solenoidal magnetic field. The ECL includes a segmented stationary drive coil which extends over the length of the coaxial accelerator and generates a traveling magnetic field therein. A second coil, mounted on the projectile, generates a static magnetic field which interacts with the travelling magnetic field of the drive coil. The projectile coil is activated either by pulsing the drive coil to induce current in the projectile coil or by direct electrical connection via brushes to the drive coil. The projectile is propelled the length of the coaxial accelerator by the repulsion force produced between the traveling magnetic field of the drive coil and the static magnetic field of the projectile coil. Thrust is determined by the amount of drive current applied. The drive current comprises pulses which must be precisely synchronized with the transit of the projectile coil through each drive coil. Consequently, the voltage of the system must increase as the velocity of the projectile increases and a high voltage commutation capability must, therefore, be provided. This is a major disadvantage of the ECL in that high launch velocities cannot, in general, be achieved due to limitations in high voltage commutation technology.

Another example of an electromagnetic launcher, the helical launcher, uses a continuous helix as the drive coil. This launcher is described in Mongeau, "Analysis of Helical Brush commutation," IEEE Transactions on Magnetics, Vol. Mag-20, No. 22 (March 1984). The interior surface of the continuous helix provides a linear commutating surface. Sliding brushes attached to the projectile excite a limited section of the drive helix. In the helical launcher, the projectile coil is excited by conventional slip rails. Since a projectile coil is required, and high voltage commutation is thus needed, the helical launcher is subject to limitations similar to those suffered by the ECL.

Other projectile accelerators of possible interest include that disclosed in U.S. Pat. No. 4,432,333 (Kurherr) which discloses a multi-coil electromagnetic projectile accelerator.

In addition to the disadvantages imposed by the need to provide high voltage commutation, previous electromagnetic projectile launchers suffer from other problems such as arcing, melting, and projectile deformation caused by the high induction in the coils.

SUMMARY OF THE INVENTION

A principal object of the present invention is to provide an electromagnetic projectile launcher which does not require high voltage commutation.

Another object of the invention is to provide an improved means of propulsion for an electromagnetic accelerator.

A further object of the present invention is to provide an economic, pollution-free projectile launcher system.

The projectile launcher of the invention can be used in sending payloads into low earth orbit, for orbit changing, for orbit maintenance of space based vehicles, and for propelling spacecraft for exploratory missions. The invention can also be used in propelling projectiles in both civilian and military armament applications. Further, the invention can be used in suspending or elevating objects.

The foregoing and other objects of the invention are achieved through the provision of an electromagnetic projectile launcher which, generally speaking, comprises means for generating a traveling magnetic field which is confined within, and travels along, a barrel of the launcher, and a superconducting projectile which is propelled by the travelling magnetic field along the barrel of the launcher. It is to be understood that the superconducting projectile can be a projectile which itself comprises or contains superconducting material or a projectile platform or other support which comprises or contains superconducting material.

Considering the underlying principles on which the present invention is based, the invention involves an innovative application of the diamagnetic repulsion associated with the Meissner effect. The Meissner effect is a characteristic associated with superconductors wherein the superconductor resists the penetration of a magnetic field into its interior. Reference is made, for example, to Rose-Innes et al, "Introduction to Superconductivity," Pergamon Press Ltd., pp. 20–22 (1969). More particularly, screening currents form on the surface of a superconductor in response to an imposed magnetic field and these screening currents induce a second magnetic field which repels the imposed magnetic field. As a result, a magnetic pressure exists between the surface of a superconductor and any magnetic field applied thereto. The present invention exploits the Meissner effect, and, in particular, this magnetic pressure, in providing electromagnetic propulsion of a projectile.

In a preferred embodiment of the invention, the electromagnetic launcher includes a superconductor surface or layer disposed aft of a projectile (either directly on the projectile or on a platform upon which the projectile is carried) and means including a single drive coil which forms a barrel in which the projectile is received, for applying a travelling magnetic field to the superconductor surface so that the resulting diamagnetic repulsion between the superconductor surface and the travelling magnetic field provides propulsion of the projectile. In an advantageous embodiment, the means for generating the traveling magnetic field comprises a segmented drive coil, and the travelling magnetic field is generated within a segmented drive coil by sequentially activating or energizing the segments of the drive coil. Activation of the segments of the drive coil is synchronized such that the resulting traveling magnetic field is always aft of the superconductor. Synchronization is accomplished with sensors disposed between each segment of the drive coil. With this arrangement, as the projectile passes each drive coil sensor, a signal is produced which is used in providing energization of the next adjacent drive coil segment to be activated.

The projectile preferably includes an arrangement for selectively supplying a liquid coolant, such as liquid nitrogen, to the superconducting layer or surface. This arrangement advantageously includes a plurality of coolant channels formed in the surface of a support wall for the superconductive layer. The channels are preferably formed by a spiral groove in that surface. The supply arrangement also includes a coolant tank and means for selectively releasing the coolant from the tank.

Other features and advantages of the invention will be set forth in, or apparent from, the following detailed description of preferred embodiments of the invention.

DETAILED DESCRIPTION OF THE PREFERRED EMBODIMENTS

Figure 1:
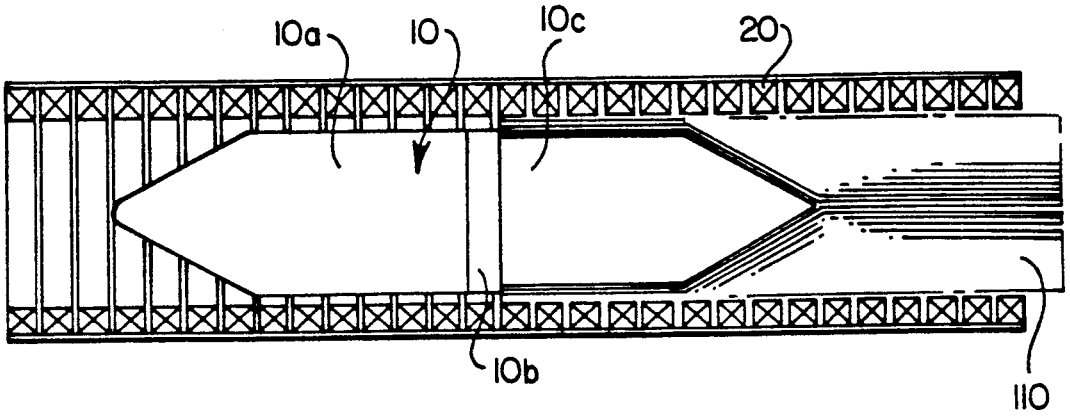
FIG. 1 is a schematic cross-sectional view of a preferred embodiment of the present invention.

Referring to FIG. 1, the basic components of a preferred embodiment of the present invention are shown. The projectile launcher of the invention basically comprises a drive coil 20 for generating a travelling magnetic field 110, and a projectile (spacecraft) 10 adapted to be propelled by the travelling magnetic field 110 within and along the drive coil 20. The projectile 10 comprises a payload section 10*a*, a separation section 10*b* and a superconducting section 10*c*, the latter providing propulsion of projectile 10 by interaction with the traveling magnetic field 110 via diamagnetic repulsion. The substantially tubular drive coil 20 forms a barrel for launching the projectile 10. Both the drive coil 20 and the projectile 10 have circular cross-sections with the inner diameter of the drive coil 20 being sized so as to closely surround the projectile 10.

As discussed above, unlike other coaxial launchers of the prior art, the projectile launcher of the present invention requires only a single activation coil, viz., the aforementioned drive coil 20. The force between the drive coil 20 and the superconducting section 10*c* of projectile 10 is due entirely to diamagnetic repulsion between the travelling magnetic field 110 and the superconducting section 10*c*. More particularly, the travelling magnetic field 110 generates screening currents on the surface of the superconducting section 10*c*. These screening currents induce a second magnetic field, which , as discussed above, repels the travelling magnetic field 110 and prevents the travelling magnetic field 110 from penetrating the superconductor section 10*c*. Therefore, a magnetic pressure is produced between the surface of the superconducting section 10*c* and the travelling magnetic field 110.

The magnetic pressure produced is inversely related to the square of flux area. In the projectile launcher of the present invention, the flux area is the difference between the inner area of the drive coil 20, i.e., the cross-sectional area defined within the inner circumference of the drive coil, and the cross sectional area of the volume enclosed by the superconducting section 10*c*. High thrust is achieved by tapering the superconducting section 10*c* of the projectile 10, thus producing a flux gradient in the magnetic field which, in turn, creates a high magnetic pressure vector in the forward direction. Consequently, the magnetic pressure varies from a maximum magnetic pressure at the forward end of the superconducting section 10*c* to zero magnetic pressure at the extreme aft or tip of the tapered superconducting section 10*c*.

The magnetic pressure on the forward surface of the superconductor section 10*c* is equal to the magnetic pressure existing between the drive coil 20 and the surface of the superconductor section 10*c* parallel to the inner wall of the drive coil 20. Diamagnetic repulsion between the inner wall of the drive coil 20 and the projectile 10 acts to maintain the superconductor section 10*c* in equilibrium near the center of the drive coil 20.

Figure 2:
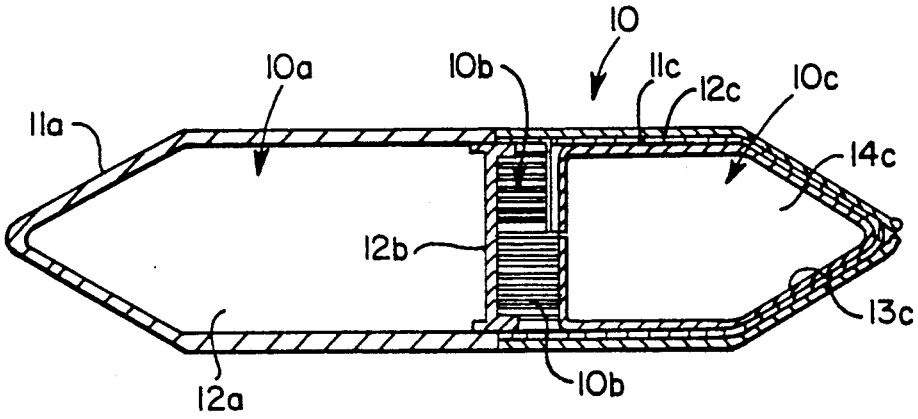
FIG. 2 is a cross-sectional view of the projectile of FIG. 1.

As mentioned above and as is shown in more detail in FIGS. 2 and 3, the projectile 10 comprises three major sections, the forward payload section 10*a*, the center separation section 10*b*, and the aft propulsion or superconducting section 10*c*. The payload section 10*a* itself comprises an outer housing wall 11*a* which defines a payload cargo area 12*a*. As will be appreciated, the shape of the payload cargo area 12*a* can be designed to accept various payload configurations. The separation section 10*b* contains insulation 11*b* and includes a bulkhead or isolating wall 12*b* provided to insulate the payload from the propulsion section 10*c*. The insulation 11*b* is used to fill any void that may exist in the propulsion section. Additionally, the separation section 10*b* may house mechanisms (not shown) to further separate the payload from the propulsion section 10*c*.

Figure 3:
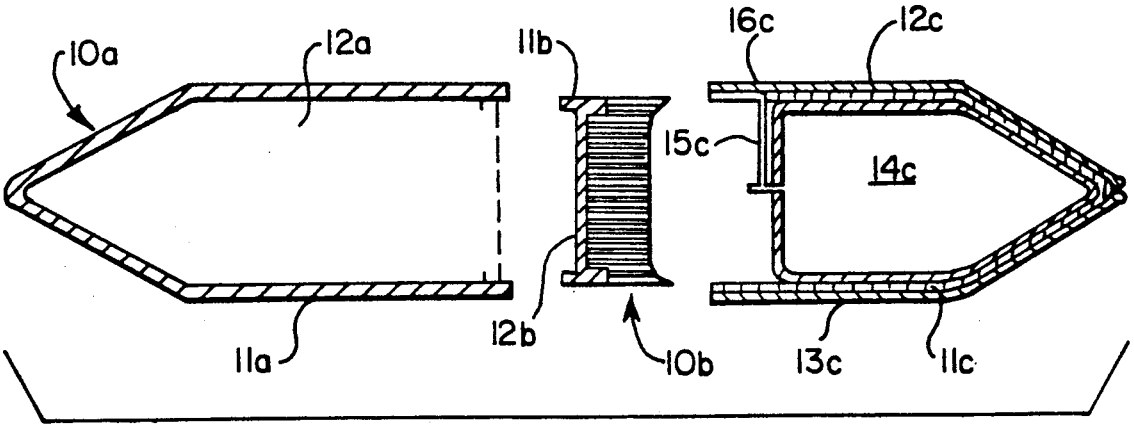
FIG. 3 is an exploded cross-sectional view of the projectile of FIG. 2.
Figure 4:
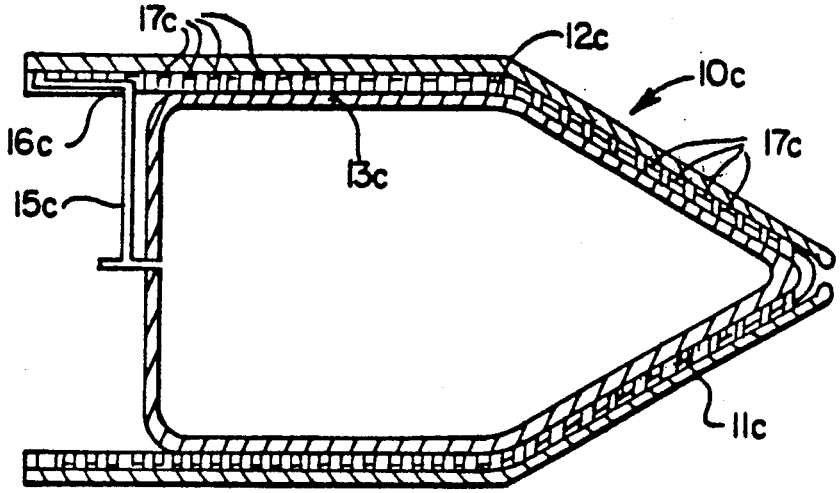
FIG. 4 is a cross-sectional view, drawn to an enlarged scale, of the aft section of the projectile of FIGS. 1 to 3.

The superconducting section 10*c* is composed of an outer shell of superconductive material, denoted 11*c*, an inner housing 12*c*, a nitrogen tank 13*c* including liquid nitrogen indicated at 14*c*, and a nitrogen supply line 15*c*. The nitrogen tank 13*c* is disposed within the inner housing 12*c*. As illustrated in FIG. 3 and FIG. 4, the inner housing 12*c*, which includes a cylindrical portion and an aft portion that is substantially conical in shape, constitutes the main support wall of the superconducting section 10*c*. The nitrogen supply line 15*c* connects the inner housing 12*c* to the nitrogen tank 13*c* at an inlet point 16*c* in inner housing 12*c* so as to enable liquid nitrogen 14*c* from tank 13*c* to be supplied thereto. More specifically, as illustrated in FIG. 4 and shown in more detail in FIG. 5, the outer surface of the inner housing 12*c* includes a spiral passage or channel 17*c* machined therein which is connected to inlet point 16c and which spirals around the outer surface of housing 12c up to the conical tip thereof. Spiral channel 17c thus enables liquid nitrogen to be supplied to the surface of inner housing 12c over the length thereof As can best be seen in FIG. 4, the width of the spiral channel 17c is somewhat greater at the conical tip portion of semiconducting section 10c than at the cylindrical portion.

Figure 5:
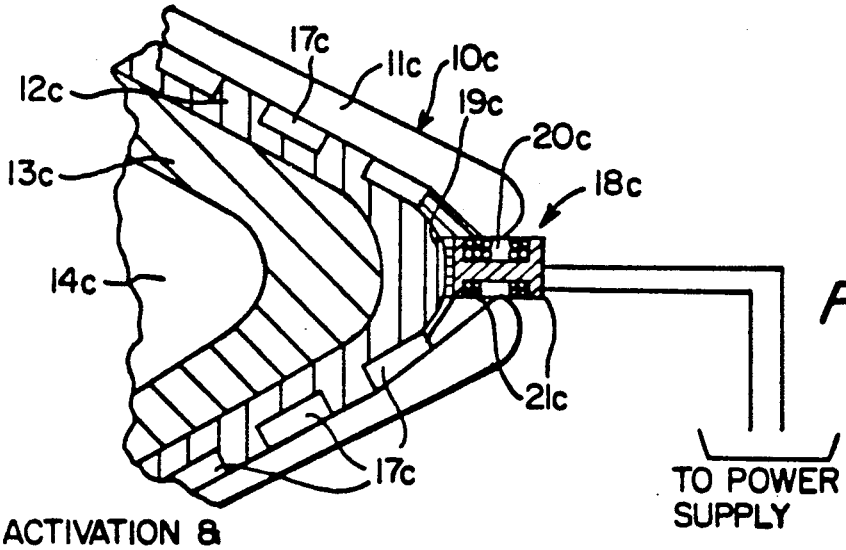
FIG. 5 is a cross-sectional view, drawn to an additionally enlarged scale, of the conical tip of the projectile of FIGS. 1 to 4.

As noted above, a layer of superconductive material 11c is securely adhered to the exterior of the inner housing 12c and has the same cylindrical-conical shape. As illustrated in FIG. 5, the conical tip of the superconductor layer 11c includes an exit aperture 18c for the liquid nitrogen 14c. In operation, the liquid nitrogen 14c flows through and along the machined path 16c between the ceramic/superconductor interface to the conical tip.

As is best seen in FIG. 5, which is a detail of the conical tip of section 10c, in one preferred embodiment of the invention, control of the flow of the liquid nitrogen 14c is effected using a piezoelectric plug assembly 18c. Piezoelectric plug assembly 18c is composed of a sealing surface material 19c, a cylindrical piezoelectric ceramic element 20c, and associated electrodes 21c. The cylindrical piezoelectric ceramic element 20c is poled such that, when a voltage is applied across the electrodes 21c, the diameter of the cylindrical piezoelectric ceramic element 20c is reduced. In use, the piezoelectric ceramic element 20c is forced out of the sealing surface material 19c by the pressure in the liquid nitrogen tank 13c, thus initiating the flow of the liquid nitrogen, indicated at 14c, down the spiral machined path 17c, and thereby providing the required cooling of the superconductive material 11c. It will be understood that the piezoelectric ceramic element 20c is placed in the sealing material 19c before the liquid nitrogen 14c is placed in the tank 13c. It will also be appreciated that other, different forms of control for the liquid nitrogen can be provided including a control valve (not shown) in supply line 15c or a frangible diaphragm (not shown) at the conical tip of the semiconducting section 10c.

It is noted that it is only necessary to cool the superconducting material 11c to a superconducting state during the time which the projectile is accelerated so that coolant is not supplied to channel 17c when the projectile 10 is not in use and is, e.g., being stored. Further, the projectile 10 is preferably stored in an insulated container (not shown) until just prior to launch.

Figure 6:
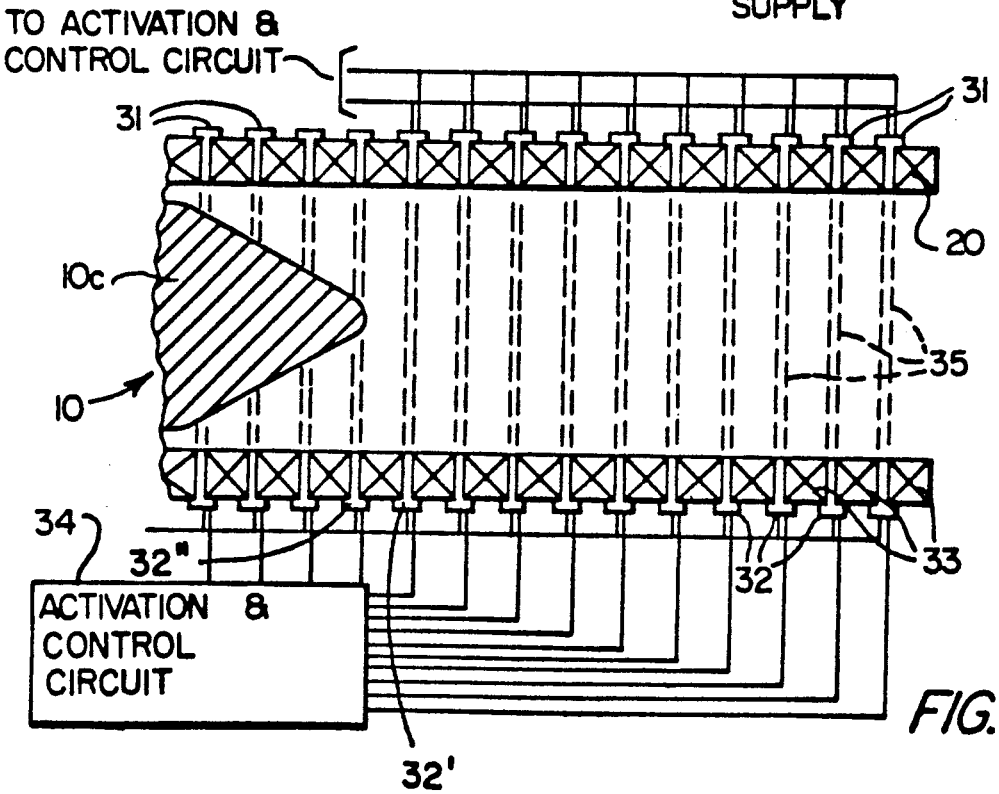
FIG. 6 is a schematic side elevational view, partially in cross section, of a launcher control system in accordance with a preferred embodiment of the present invention.

Referring to FIG. 6, a control system for the drive coil 20 is shown. The control system includes a plurality of laser light sources 31 disposed in serial relation along one side of coil 20 between the turns of the coil, as illustrated, and a corresponding plurality of optical sensors 32 which are disposed in serial relationship along the opposite side of coil 20 between the turns thereof, so that an optical sensor 32 is positioned opposite each of said laser light source 30. The drive coil 20 itself comprises a plurality of drive coil segments 33 which are energized independently of one another under the control of an activation and control circuit 34.

The travelling magnetic field 110 is generated by sequentially energizing each segment 33 of the coil 20. The activation of each drive coil segment 33 is controlled by control circuit 34 and is synchronized such that the resulting traveling magnetic field 110 is always located aft of the projectile 10. This synchronization is accomplished using the optical sensors 32 disposed between each drive coil segment 33. In particular, each sensor normally receives a laser light beam 35 from the laser light source 31 located thereacross. Thus, as the projectile 10 moves along coil 20, the forward and aft tips of the projectile 10 will pass by and thus block or unblock a laser beam or beams 35 from individual ones of the light sources 31, in sequence, so as to permit the laser light to not fall or to fall on the corresponding optical sensor 32. Accordingly, the position of the projectile 10 in the coil 20 can be determined from the optical sensors 32 which are not receiving laser light.

Considering this operation further, referring to the example illustrated in FIG. 6 and assuming that projectile 10 is moving from right to left, and considering that coil activation is due to the motion of the aft tip, for the position of projectile 10 illustrated, a "new" light sensor has just been unblocked and this sensor, and all other sensors 32 located downstream thereof, are illuminated by corresponding laser light beams 35. On the other hand, the next adjacent light sensor and all other sensors 32 upstream thereof which lie laterally adjacent to projectile 10, are still blocked by the projectile. As each new light sensor 32 is unblocked, i.e., exposed to the corresponding laser light beam 35 by the passage of projectile 10 thereby, that sensor generates an output signal which is transmitted to activation and control circuit 32. Thus, in operation, as the projectile 10 passes by each "new" drive coil sensor 32, a corresponding signal is transmitted to activation and control circuit 34 which, in turn, causes the next forward or upstream drive coil segment 33 to be activated, thereby generating the new leading edge of the traveling magnetic drive field 110. It will be appreciated that control circuit 34 can be simple in construction in that the purpose thereof is simply to receive a position or timing signal from the laser light sensors 32 and to generate a corresponding energizing signal for the appropriate coil signal 33 based on that signal.

Figure 7:
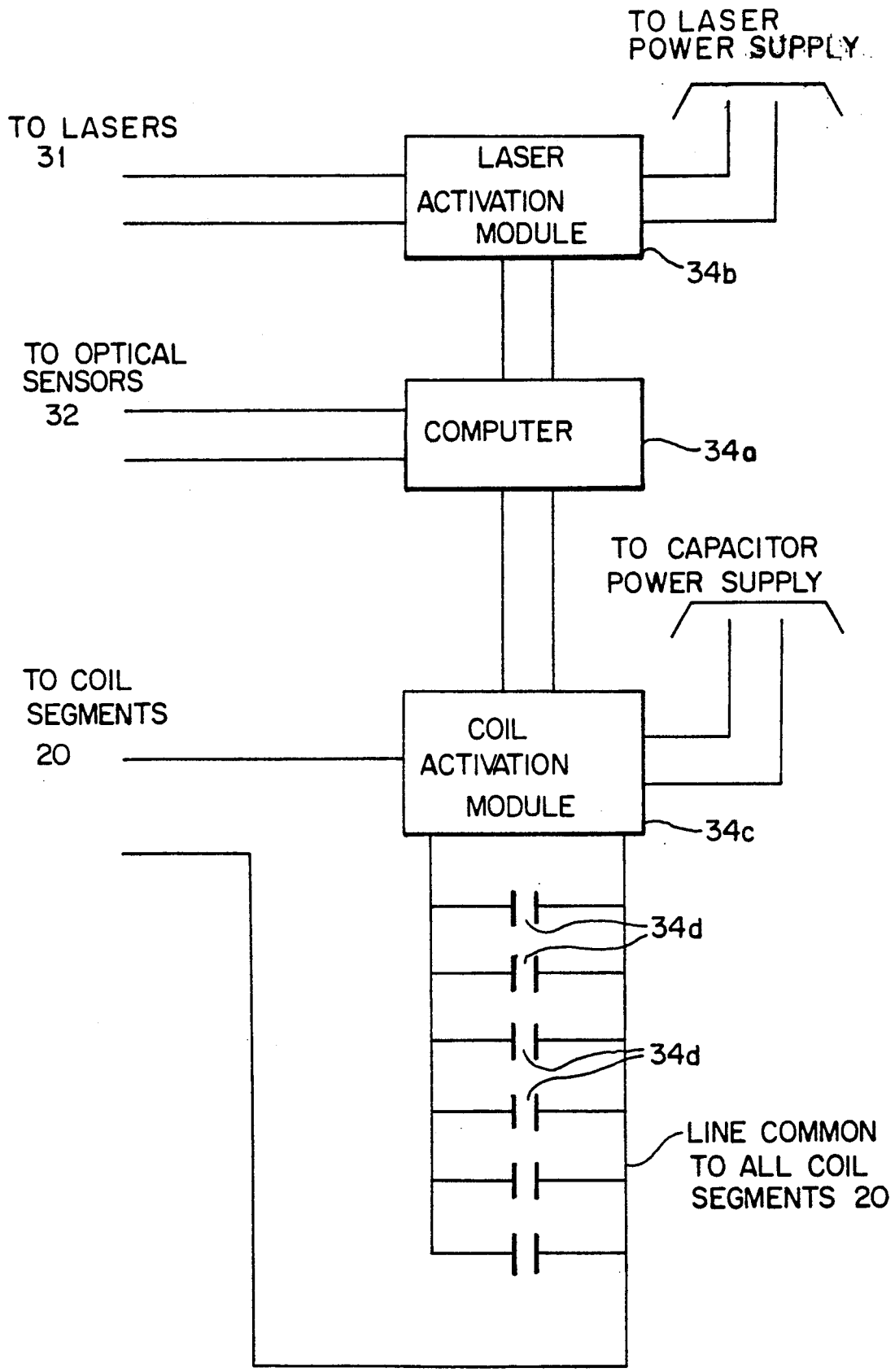
FIG. 7 is a schematic block diagram of the control and activation circuit of FIG. 6.

Referring to the example in FIG. 7, a schematic block diagram of a simple implementation of the activation and control circuit 34 is shown. The heart of this system is a computer 34a (such as made by IBM, Apple, and others) which is connected to a laser activation circuit or module 34b, a coil activation circuiter module 34c, and the optical sensors 32 (not shown in FIG. 7). connection to these are accomplished through interface cards (not shown) for the IEEE-480 bus which are designed to directly plug into the expansion slots of most computers. Interface boards for data acquisition and control, together with the software to control them can be purchased through such companies as the MetraByte Corporation, 440 Myles Standish Boulevard, Taunton, Mass., 02780. The computer 34a, by means of the interface boards and programming, initiates the supply of power to the lasers 31 (not shown in FIG. 7) through the laser activation module 34b, as well as receives signals from optical sensors 32, and decodes the signals and directs the coil activation module 34c to supply power to whichever coil segment 20 needs power. The laser activation module 34b can be simple composed of a relay switch (not shown) which, when closed, allows power to be applied to the lasers. The coil activation module 34c can also be simply composed of multiple relays (not shown) which direct power from multiple charged capacitive banks 34d to the individual coil segments as is required to propel the projectile 10.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A superconducting projectile launcher system comprising a projectile having a front surface and a rear surface, said rear surface including an outer layer of a superconduting material and said projectile further comprising cooling means for selectively maintaining said outer layer in a superconducting state, said cooling means including a tank for liquid coolant contained within said projectile and means for supplying liquid coolant from said tank to the inner surface of said outer layer to provide cooling thereof;

a barrel in which said projectile is received; and means disposed along said barrel for generating a magnetic field adjacent to said rear surface of said projectile so as to provide propulsion of said projectile and for causing said magnetic field to propagate along said barrel behind said projectile to cause acceleration of said projectile along said barrel.

2. The system of claim 1 wherein said means of generating a magnetic field comprises a magnetic field drive coil comprising a plurality of individually energizable drive segments and means for sequentially energizing the drive segments of said drive coil.

3. The system of claim 2 wherein said means for generating said magnetic field further includes sensor means, comprising sensors disposed between pairs of said segments, for detecting the position of said projectile along said coil, and means, connected to said sensor means, for energizing said drive segments responsive to the output of said sensor means.

4. The system of claim 3 wherein said sensor means further comprises light transmitter means, comprising light sources disposed between pairs of said segments, for generating a plurality of laterally spaced light beams across the path of movement of said projectile, said sensors comprising optical sensors for detecting the interruption of a said light beam by said projectile during movement thereof.

5. The system of claim 1 wherein said projectile includes an inner support wall for said superconducting layer and said cooling means includes a spiral cooling channel, formed in the outer surface of said support wall, for carrying said liquid coolant.

6. The system of claim 1 wherein the front and the rear surfaces of said projectile are tapered.

7. A superconducting projectile launcher system comprising:

a superconducting projectile;

magnetic field drive coil in which said superconducting projectile is received; and means for generating a traveling magnetic field which travels along said coil and causes said superconducting projectile to be propelled along said coil, said projectile comprising a superconducting outer layer and cooling means for selectively maintaining said outer layer in a superconducting state, said cooling means including a tank for liquid coolant contained within said projectile, said projectile including an inner support wall for said superconducting layer and said cooling means including a spiral cooling channel, formed in the outer surface of said support wall, for carrying said liquid coolant.

8. A superconducting projectile launcher system comprising:

a superconducting projectile;

magnetic drive coil in which said superconducting projectile is received; and means for generating a travelling magnetic field which travels along said coil and causes said superconducting projectile to be propelled along said coil, said projectile comprising a superconducting outer layer and cooling means for selectively maintaining said outer layer in a superconducting state, said cooling means including a tank for liquid coolant contained within said projectile and a control plug assembly for selectively controlling the flow of liquid coolant from said tank to said superconducting outer layer.

9. A superconducting projectile launcher system comprising:

a superconducting projectile;

magnetic drive coil in which said superconducting projectile is received; and means for generating a travelling magnetic field which travels along said coil and causes said superconducting projectile to be propelled along said coil, said projectile comprising a superconducting outer layer and cooling means for selectively maintaining said outer layer in a superconducting state, said projectile including an inner support wall for said superconducting layer and said cooling means including a spiral cooling channel, formed in the outer surface of said support wall, for carrying said liquid coolant.

* * * * *